US008672623B2

(12) United States Patent
Harper

(10) Patent No.: US 8,672,623 B2
(45) Date of Patent: Mar. 18, 2014

(54) STATOR VANE ASSEMBLY

(75) Inventor: Cedric B Harper, Derby (GB)

(73) Assignee: Rolls-Royce PLC, London (GB)

( * ) Notice: Subject to any disclaimer, the term of this patent is extended or adjusted under 35 U.S.C. 154(b) by 810 days.

(21) Appl. No.: 12/720,309

(22) Filed: Mar. 9, 2010

(65) Prior Publication Data

US 2010/0254804 A1 Oct. 7, 2010

(30) Foreign Application Priority Data

Apr. 3, 2009 (GB) ..... 0905729.0

(51) Int. Cl.
*F01D 9/02* (2006.01)
*F01D 9/04* (2006.01)

(52) U.S. Cl.
USPC ..... 415/209.2; 415/209.4; 416/500

(58) Field of Classification Search
USPC ..... 415/134, 137, 142, 191, 209.2, 209.3, 415/209.4, 210.1, 211.2; 416/248, 500
See application file for complete search history.

(56) References Cited

U.S. PATENT DOCUMENTS

| | | | | | |
|---|---|---|---|---|---|
| 2,914,300 | A * | 11/1959 | Sayre | 415/135 |
| 4,395,195 | A * | 7/1983 | De Cosmo et al. | 415/137 |
| 4,832,568 | A * | 5/1989 | Roth et al. | 415/189 |
| 4,907,946 | A * | 3/1990 | Ciokajlo et al. | 415/209.3 |
| 4,940,386 | A * | 7/1990 | Feuvrier et al. | 415/209.2 |
| 5,074,752 | A * | 12/1991 | Murphy et al. | 415/209.4 |
| 5,083,900 | A * | 1/1992 | Carletti et al. | 415/209.3 |
| 5,272,869 | A * | 12/1993 | Dawson et al. | 60/796 |
| 5,494,404 | A * | 2/1996 | Furseth et al. | 415/209.3 |
| 5,765,993 | A * | 6/1998 | Weiss | 415/209.2 |
| 6,619,917 | B2 * | 9/2003 | Glover et al. | 415/209.3 |
| 6,910,860 | B2 * | 6/2005 | Glover et al. | 415/209.3 |
| 7,086,831 | B2 * | 8/2006 | Harper | 415/209.3 |
| 7,311,495 | B2 * | 12/2007 | Ashley et al. | 415/209.4 |
| 7,494,316 | B2 * | 2/2009 | Barnett et al. | 415/119 |
| 2010/0254804 | A1 * | 10/2010 | Harper | 415/119 |

FOREIGN PATENT DOCUMENTS

| | | | |
|---|---|---|---|
| EP | 0 277 884 | A2 | 8/1988 |
| EP | 1 762 703 | A2 | 3/2007 |
| EP | 1 911 931 | A2 | 4/2008 |
| GB | 1123586 | | 8/1968 |
| GB | 2 418 709 | A | 4/2006 |
| GB | 2 427 900 | A | 1/2007 |
| WO | WO 2007/030925 | A1 | 3/2007 |

OTHER PUBLICATIONS

Great Britain Search Report issued in Great Britain Patent Application No. 0905729.0 on Jul. 30, 2009.
Jan. 28, 2014 Extended European Search Report issued in European Application No. 10250449.5.

* cited by examiner

*Primary Examiner* — Edward Look
*Assistant Examiner* — Christopher R Legendre
(74) *Attorney, Agent, or Firm* — Oliff PLC

(57) ABSTRACT

A stator vane assembly includes: inner and outer vane supports, and vanes extending radially between the supports. The supports have openings for receiving the ends of the vanes, and each vane is connected to the supports by a vane boot. Each vane boot has: a rim portion shaped to locate the boot within the corresponding opening in the vane support, the rim portion engaging with the inner surface defining the opening, an abutting portion for abutting against the vane support in the region surrounding the opening, and a vane pocket for accommodating the end of the vane. The vane pockets of the vane boots are shaped so as to position the vane with a predetermined stagger angle.

13 Claims, 3 Drawing Sheets

STATOR VANE ASSEMBLY

The invention relates to a stator vane assembly.

Stator vane assemblies are known. They are provided, for example, in aeroengines. FIG. 1 shows a turbofan gas engine 10 which comprises, in the flow series of the gas stream, an intake 12, a fan section 14, a compressor section 16, a combustion section 18, a turbine section 20 and an exhaust 22. The fan section 14 comprises a fan rotor 24 carrying a plurality of circumferentially spaced radially outwardly extending fan rotor blades 26. The fan rotor blades 26 are arranged in a fan duct 28 defined partially by a fan casing 30 surrounding the fan rotor 24 and fan rotor blades 26. The fan casing 30 is secured to a core engine casing 32 by a plurality of circumferentially spaced radially extending fan outlet guide vanes 34 which are secured to the fan casing (outer ring) 30 and the core engine casing (inner ring) 32.

FIG. 2 shows a fan outlet guide vane 34 connected to an inner ring 31 and an outer ring 32. The inner ring is a forged ring having machined stubs 33 provided thereon. Each vane 34 is attached by welding to a corresponding stub 33 so as to form the stator vane assembly. In order to reduce cost, each stub is made as small as possible so that the forging size is reduced.

U.S. Pat. No. 4,832,568 discloses an alternative method for mounting vanes in a stator vane assembly. Each vane is connected to the outer ring by locating its end in a recess provided in a mounting fairing of the outer ring. An elastomeric potting medium may be provided between the vane end and the inner walls of the recess.

Welding the vanes to stubs provided on the inner ring, as shown in FIG. 2, is a satisfactory method of mounting vanes if each and every vane is metallic. It is, however, sometimes desired to provide some vanes at specific positions as composite vanes, to reduce weight. Such vanes cannot be mounted in the structure shown in FIG. 2.

The method disclosed in U.S. Pat. No. 4,832,568 is designed for rapid assembly and disassembly of vanes in the assembly. Disadvantageously, it does not provide much flexibility in positioning the blades.

According to the invention, there is provided a stator vane assembly comprising: an inner vane support; an outer vane support; and a plurality of vanes extending radially between the inner vane support and the outer vane support; wherein each of the inner and outer vane supports has openings for receiving respective first and second ends of the vanes and each said vane is connected to the inner vane support at its first end by a first vane boot received in a said opening and to the outer vane support at its second end by a second vane boot received in another said opening, wherein each vane boot has a rim portion shaped to locate the boot within the corresponding opening in the vane support, the rim portion engaging with the inner surface defining the opening, an abutting portion for abutting against the vane support in the region surrounding the opening, and a vane pocket for accommodating the end of the vane, wherein the vane pockets of the first and second vane boots of a said vane are shaped so as to position the vane with a predetermined stagger angle.

Advantageously, a vane boot is provided for both ends of the vane, i.e. so as to attach the vane to each of the first and second vane supports. Each such pair of boots can be selected so as to mount its associated vane with a particular stagger angle.

In one embodiment, an elastomeric damping medium is provided in the vane pocket of at least some of the vane boots. Preferably the thickness of the elastomeric damping medium varies at different locations in the vane pocket so as to provide tuned damping of the vibrations. More preferably, each vane boot has the elastomeric damping medium in its vane pocket.

In a further embodiment, fastening means are provided for fastening each vane boot to the inner or outer vane support. The fastening means may include openings provided in the vane support and the boot for receiving a screw.

Preferably, the fastening means is adjustable so as to enable adjustment of the position of the vane boot on the vane support, thereby varying the stagger (vane yaw) angle of the vane boot and hence the vane.

In one such embodiment the fastening means comprises a pivot connecting the vane boot to the vane support at a first position on the vane boot and a pin and slot arrangement connecting the vane boot to the vane support at a second position on the vane boot.

The pin and slot arrangement allows simple adjustment of the vane yaw angle. The pin may be provided on the vane support and the slot on the vane boot. Alternatively, the pin may be provided on the vane boot and the slot on the vane support. Further alternatively, the pin may be a screw which passes through a slot on the boot and into the vane support.

In another such embodiment, the fastening means includes at least one adjustable fastening element which acts as a cam against the vane boot when adjusted. For example, a plurality of eccentric screws may be provided as the at least one adjustable fastening element. Adjustment of the eccentric screws acts on the vane boot, enabling the stagger angle to be varied.

In a further embodiment, the stagger angle of the vanes is set such that it varies between at least some of the vanes.

The invention also provides a method of mounting vanes in a stator vane assembly as described above, the method comprising: determining a desired stagger angle for each vane; providing first and second vane boots for each vane so as to set the vane at the desired stagger angle on the inner and outer vane supports, wherein the vane pocket formed within the first and second vane boots is formed to provide the desired stagger angle or wherein the first and second vane boots are positioned on the inner and outer vane supports using adjustable fastening means to provide the desired stagger angle; and assembling the vanes and vane boots within the inner and outer vane supports.

Advantageously, appropriate selection or adjustment of the first and second vane boots enables the desired stagger angle to be set for each vane. Further, when changing the arrangement it is only necessary to change the vane boots, which are smaller, lower cost parts.

Reference is now made, by way of example only, to the accompanying drawings in which.

Figure 1:
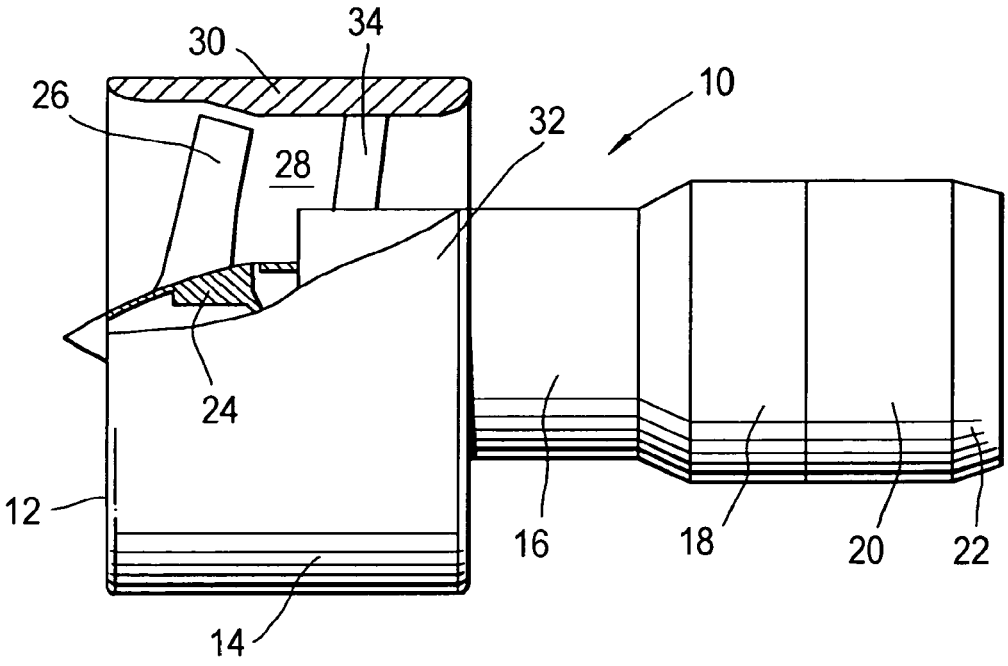
FIG. 1 shows a turbofan gas turbine engine.
Figure 2:
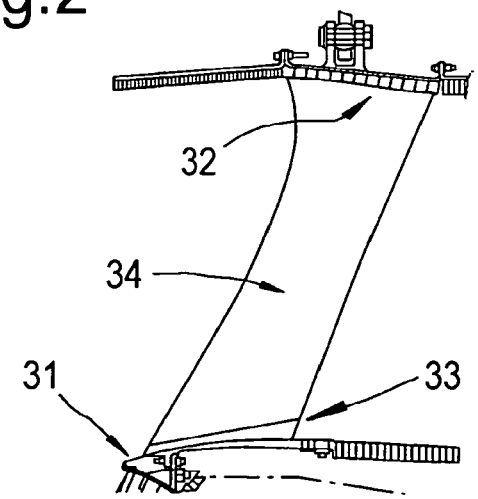
FIG. 2 shows connection of a vane to a stub provided on an inner ring.
Figure 3:
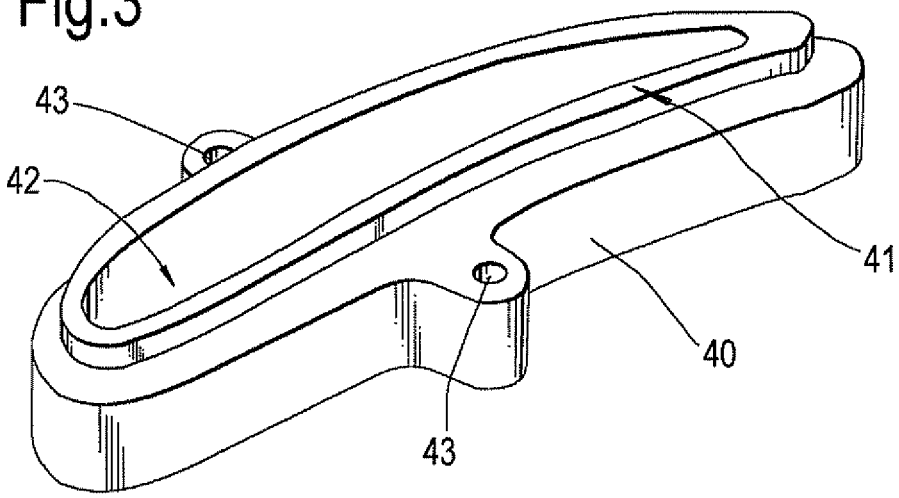
FIG. 3 is a perspective view of a vane boot.

FIG. 3 is a perspective view of a vane boot for use in a stator vane assembly of an embodiment of the invention. The vane boot 40 has a rim portion (boot location lip) 41 for locating the boot 40 on a vane support such as the inner or outer ring, a vane pocket 42 for receiving the end of a vane and boot fixing holes 43 for fastening the boot to the vane support (e.g. inner or outer ring). Each boot can be produced from a casting, or be machined from solid or injection moulded.

In the stator vane assembly, each end of each vane is provided with a vane boot 40. Each vane is therefore connected to the inner ring through a first vane boot and to the outer ring through a second vane boot. The vane pocket 42 of each vane boot is shaped so as to hold the vane at a particular angle. In this regard, the first and second vane boots form a pair which are selected so as to mount the vane in the stator vane assembly with a given stagger angle. The boot fixing holes 43 are provided at the same position on each boot for attachment of the boot 40 to the inner or outer ring. Due to the common location of the fixing holes, the vane stagger of a vane can be easily changed by replacing a boot, rather than having to re-machine either or both of the inner and outer rings.

Preferably, different types of boot are provided, each type of vane boot having a different profile for its vane pocket. Accordingly, by selecting appropriate vane boot pairs the stagger angle of each vane can be set to a desired angle. Further, the boot 40 is a small component which can be made quickly, e.g. by machining or injection moulding, and which is relatively cheap. By contrast, the rings are much larger and require specialist casting and machining facilities with much longer lead times. Thus, boots having the desired vane pocket profile can be readily made.

Further, the use of such boots 40 in the stator vane assembly makes it possible to adjust the stagger angle of one vane relative to that of an adjacent vane, for example to compensate for upstream/downstream struts/airflow disturbances, by selection of the boots for each vane.

Figure 4:
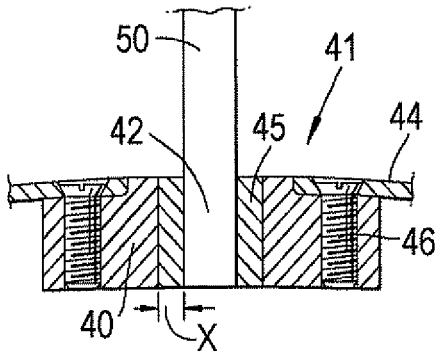
FIG. 4 is a cross-sectional view of the boot of FIG. 3 when installed on the inner ring.
Figure 5:
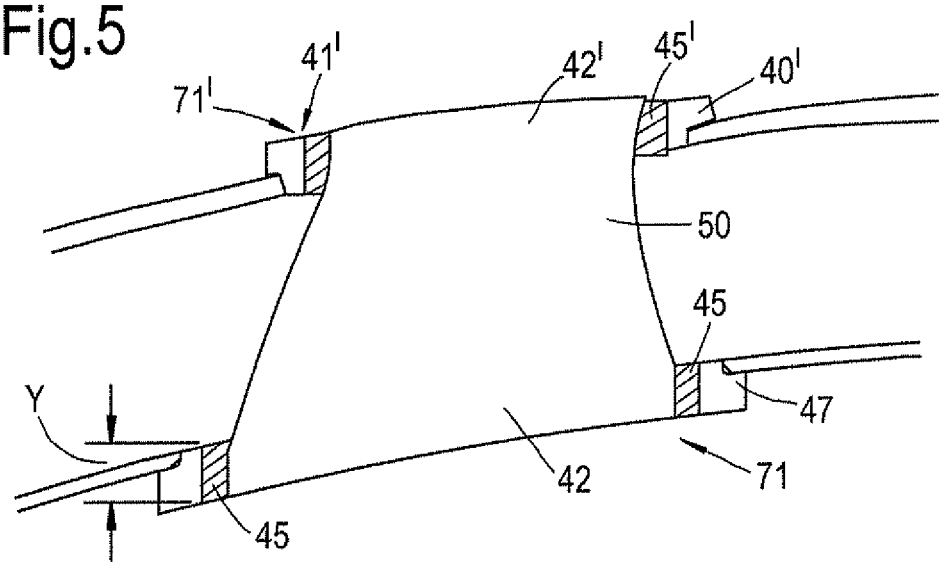
FIG. 5 is another cross-sectional view of the boot of FIG. 3 when installed on the inner ring.

FIGS. 4 and 5 are cross-sectional views of the boot of FIG. 3 when installed on the inner ring vane support 71. The rim portion 41 locates the boot within an opening in the inner ring 44 and contacts the surface of the inner ring defining the opening. An abutting portion 47 abuts against the surface of the inner ring 44 in the region surrounding the opening. The boot 40 is connected to the inner ring 44 by screws 46 fastened into its boot fixing holes 43. A vane 50 has an end received in the vane pocket 42 of the boot. A potting medium 45 is provided in the vane pocket 42 around the end of the vane. The potting medium 45 is an elastomeric damping medium which acts to dampen vibrations of the vane. The thickness (as shown by the dimensions X and Y) of the potting medium 45 may vary at different positions in the vane pocket 42 so as to provide tuned damping of the vibrations of the vane 50. Due to the ease of manufacture of the boots, boots having different damping characteristics can be readily produced.

The outer ring shown in FIG. 5 vane support 71' has a corresponding vane boot 40', rim portion 41', potting medium 45' and vane pocket 42' that together secure the vane 50.

Advantageously, the arrangement shown in FIGS. 4 and 5 eliminates the need for vane stubs, thus reducing the size of the forging and machining time and cost. In addition, it reduces cost during development or in service by allowing quick and easy changes to vane stagger angle without having to change (or machine) the complete inner ring. Further, it enables the installation of composite vanes within a metallic ring structure.

Further, it enables adjustments to be readily made during the development phase. Because the boots 40 can be easily manufactured, the profiles of the vane pockets 42 of the boots can be readily changed. In this way, during development, vane stagger and vane camber can be readily altered so as to optimise these factors. This can be used to set a vane at a different stagger angle to its neighbour, if desired. Similarly, vane damping can be adjusted easily during the development phase by varying the thickness of the damping medium 45 in the manufactured boots. For example, the dimensions X and Y of the damping medium shown in FIGS. 4 and 5 can be varied (e.g. by making the vane pocket smaller or larger in the relevant area).

The arrangement of the vane boots on the outer ring is the same as described above with reference to the inner ring.

Figure 6:
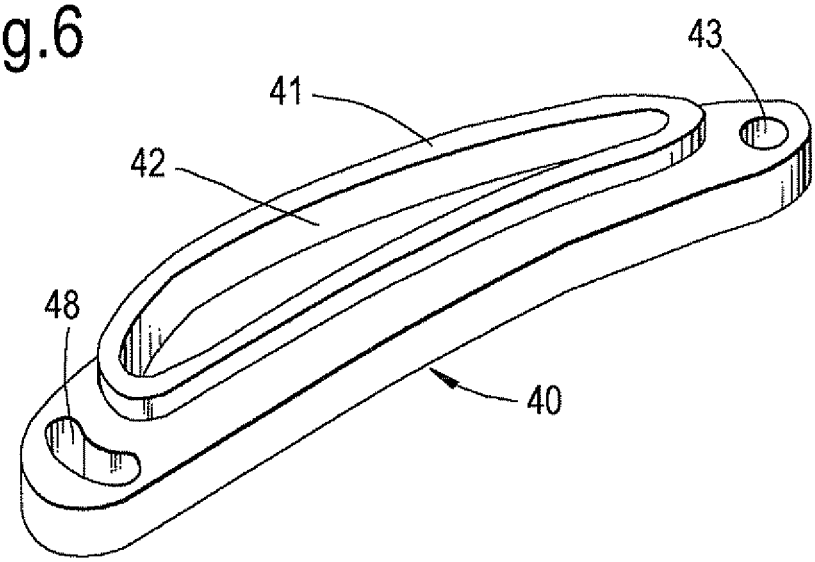
FIG. 6 is a perspective view of another vane boot.

FIG. 6 is a perspective view of another vane boot for use in a stator vane assembly of an embodiment of the invention. The vane boot is similar to that shown in FIG. 3, but has a single fixing hole 43 and a slot 48 provided instead of the two fixing holes 43.

The vane boot is fastened to the inner or outer ring at the hole 43 by means of a screw, in similar fashion to the fastening in FIG. 3. The screw acts as a pivot around which the vane boot 40 can be rotated. A further screw is positioned through the slot 48 to engage with a hole in the inner or outer ring. This screw acts together with the slot as a 'pin and slot' arrangement. By loosening the further screw, the end of the vane boot 40 in which the slot 48 is provided can be rotated about the pivot.

The stagger angle can therefore be readily changed within a predetermined range without having to replace the vane boot. This advantageously reduces the time and cost needed to make changes.

Figure 7:
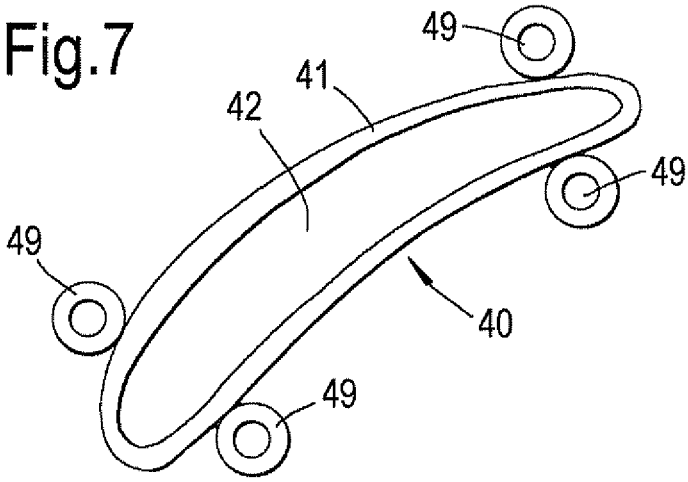
FIG. 7 is a perspective view of still another vane boot.

FIG. 7 is a perspective view of another vane boot for use in a stator vane assembly of an embodiment of the invention. The vane boot is similar to that shown in FIG. 3, but is mounted between 'cam' screws 49 instead of having fixing holes 43. The 'cam' screws are adjustable fixing elements which act as a cam on the vane boot 40 when screwed into or out of the inner or outer ring. In order to act in this manner they are eccentric screws having an elliptical cross-section as can be seen in FIG. 7.

By adjustment of the eccentric screws, the stagger angle of the boot (and hence of the vane) can be varied. The stagger angle can therefore be readily changed without having to replace the vane boot. This advantageously reduces the time and cost needed to make changes, for example during development. It could also be used to make fine adjustments in situations such as racing, where the engine is tuned for the particular race conditions.

The invention claimed is:

1. A stator vane assembly comprising:

an inner vane support;

an outer vane support;

a plurality of vanes extending radially between the inner vane support and the outer vane support; wherein each of the inner and outer vane supports has openings defined by the inner and outer vane supports for receiving respective first and second ends of the vanes and each said vane is connected to the inner vane support at its first end by a first vane boot received in a said opening and to the outer vane support at its second end by a second vane boot received in another said opening, wherein each vane boot has a rim portion shaped to locate the boot within the corresponding opening in the vane support, the rim portion engaging with the inner surface defining the opening, an abutting portion for abutting against the vane support in the region surrounding the opening, and a vane pocket for accommodating the end of the vane, wherein the vane pockets of the first and second vane boots of a said vane are shaped so as to position the vane with a predetermined stagger angle; and a fastener for fastening each vane boot to the inner or outer vane support, the fastener being adjustable so as to adjust the position of the vane boot on the vane support, thereby varying the stagger angle.

2. A stator vane assembly as claimed in claim 1, wherein an elastomeric damping medium, for dampening vibrations of the vane, is provided in the vane pocket of at least some of the vane boots.

3. A stator vane assembly as claimed in claim 2, wherein the elastomeric damping medium is provided at a thickness that varies at different locations in the vane pocket so as to provide tuned damping of the vibrations.

4. A stator vane assembly as claimed in claim 2, wherein each vane boot has the elastomeric damping medium in its vane pocket.

5. A stator vane assembly as claimed in claim 1, wherein the fastener includes openings provided in the vane support and the boot for receiving a screw.

6. A stator vane assembly as claimed in claim 1, wherein the fastener comprises a pivot connecting the vane boot to the vane support at a first position on the vane boot and a pin and slot arrangement connecting the vane boot to the vane support at a second position on the vane boot.

7. A stator vane assembly as claimed in claim 1, wherein the fastener includes at least one adjustable fastening element which acts as a cam against the vane boot when adjusted.

8. A stator vane assembly as claimed in claim 7, wherein a plurality of eccentric screws are provided as the at least one adjustable fastening element.

9. A stator vane assembly as claimed in claim 1, wherein the stagger angle varies between at least some of the vanes.

10. A gas turbine engine including a stator vane assembly as claimed in claim 1.

11. A method of mounting vanes in a stator vane assembly as claimed in claim 1, the method comprising:

determining a desired stagger angle for each vane;

providing first and second vane boots for each vane so as to set the vane at the desired stagger angle on the inner and outer vane supports, wherein the first and second vane boots are positioned on the inner and outer vane supports using adjustable fastening means to provide the desired stagger angle; and assembling the vanes and vane boots within the inner and outer vane supports.

12. A method as claimed in claim 11, wherein the vane pocket of each vane boot is formed to also provide a desired vane camber.

13. A method as claimed in claim 11, further comprising providing an elastomeric damping medium in each vane boot to dampen vibrations of the blade.

* * * * *